US008763946B1

(12) United States Patent
Keily

(10) Patent No.: US 8,763,946 B1
(45) Date of Patent: Jul. 1, 2014

(54) SHEET MATERIAL DISPENSER APPARATUS

(75) Inventor: Joel P. Keily, Corona, CA (US)

(73) Assignee: Dispensing Dynamics International, City of Industry, CA (US)

( * ) Notice: Subject to any disclaimer, the term of this patent is extended or adjusted under 35 U.S.C. 154(b) by 632 days.

(21) Appl. No.: 12/932,655

(22) Filed: Mar. 2, 2011

Related U.S. Application Data

(60) Provisional application No. 61/339,779, filed on Mar. 9, 2010.

(51) Int. Cl.
*B65H 63/08* (2006.01)

(52) U.S. Cl.
USPC ..... 242/563; 242/564.2

(58) Field of Classification Search
USPC ..... 242/564, 564.1, 564.2, 563; 312/34.22, 312/34.8; 235/462.01, 462.13, 454, 470
See application file for complete search history.

(56) References Cited

U.S. PATENT DOCUMENTS

| | | | | |
|---|---|---|---|---|
| 4,796,825 | A | 1/1989 | Hawkins | |
| 6,412,655 | B1 | 7/2002 | Stuetzel et al. | |
| 6,695,246 | B1 | 2/2004 | Elliott et al. | |
| 7,040,566 | B1 | 5/2006 | Rodrian et al. | |
| 7,044,421 | B1 | 5/2006 | Omdoll et al. | |
| 8,511,598 | B2 * | 8/2013 | Neveu et al. | 242/563 |
| 2005/0145745 | A1 * | 7/2005 | Lewis et al. | 242/563 |
| 2005/0171634 | A1 | 8/2005 | York et al. | |
| 2006/0173576 | A1 | 8/2006 | Goerg et al. | |
| 2008/0048064 | A1 * | 2/2008 | Lemaire et al. | 242/560.1 |
| 2011/0215188 | A1 * | 9/2011 | Lalau et al. | 242/564.1 |

FOREIGN PATENT DOCUMENTS

WO WO 2009/055473 4/2009

* cited by examiner

*Primary Examiner* — William A Rivera
(74) *Attorney, Agent, or Firm* — Thomas R. Lampe

(57) ABSTRACT

A paper towel roll support in the form of a roll support plug wholly or partially comprised of electrically conductive material and located at an end of a roll of paper toweling is employed to support the roll. Sensed capacitance between the plug and an electrically conductive member on a roll support arm controls operation of the dispenser apparatus.

3 Claims, 2 Drawing Sheets

SHEET MATERIAL DISPENSER APPARATUS

This application is based on and claims the benefit of U.S. Provisional Patent Application Ser. No. 61/339,779, filed Mar. 9, 2010.

TECHNICAL FIELD

This invention relates to sheet material dispensing and more particularly to paper towel dispensing.

BACKGROUND OF THE INVENTION

It is of course well known to dispense paper toweling and other types of paper sheet material from rolls of such material. Commonly, the dispensers employed for such purpose, particularly with respect to paper toweling, utilize spaced supports for supporting the rolls at the ends thereof and allowing rotation of the roll when toweling is being dispensed from the dispenser. It is also well known to employ an electric motor in a paper towel dispenser to position a leading end portion of the toweling external of the dispenser for access by a consumer. This action results in rotation of the roll as it is unwound.

As will be seen below, the dispenser apparatus of the present invention incorporates a capacitance sensing system which is utilized to control operation of an electric motor employed to unwind sheet material in the form of paper toweling from a roll. Sensed capacitance characteristics of roll support structure must be of a selected predetermined nature to operate the dispenser.

The following patent documents having a degree of pertinence to the present invention are known: U.S. Pat. No. 7,044,421, issued May 16, 2006, U.S. Pat. No. 7,040,566, issued May 9, 2006, U.S. Pat. No. 6,695,246, issued Feb. 24, 2004, U.S. Pat. No. 6,412,655, issued Jul. 2, 2002, U.S. Pat. No. 4,796,825, issued Jan. 10, 1989, U.S. Patent App. Pub. No. US 2006/0173576, published Aug. 3, 2006, U.S. Patent App. Pub. No. US 2005/0171634, published Aug. 4, 2005, and PCT Pub No. WO 2009/055473, published Apr. 30, 2009.

Several arrangements showing use of bar codes, smart tags, and metal coatings employed with paper towel cores are disclosed in the located prior art which are sensed at the roll support for detecting information about the product, for example to provide lock-out capability. There is no teaching or suggestion in the known prior art of the capacitance dispenser apparatus as disclosed and claimed herein.

DISCLOSURE OF INVENTION

The present invention relates to sheet material dispenser apparatus for dispensing sheet material from a roll of sheet material.

The sheet material dispenser apparatus includes a plug positioned at an end of a roll of sheet material, the plug being at least partially formed of electrically conductive material.

Dispenser drive mechanism causes rotation of the roll of sheet material during dispensing of sheet material therefrom.

An electrically conductive member is fixedly mounted adjacent to the plug and is cooperable with the plug to form an electronic signature based on the capacitance between the plug and the electrically conductive member. The electrically conductive member is operatively associated with the dispenser drive mechanism to allow operation of the dispenser drive mechanism to dispense sheet material from the roll of sheet material only when the electronic signature is of a selected predetermined nature.

Other features, advantages and objects of the present invention will become apparent with reference to the following description and accompanying drawings.

BEST MODE FOR CARRYING OUT THE INVENTION

Figure 1:
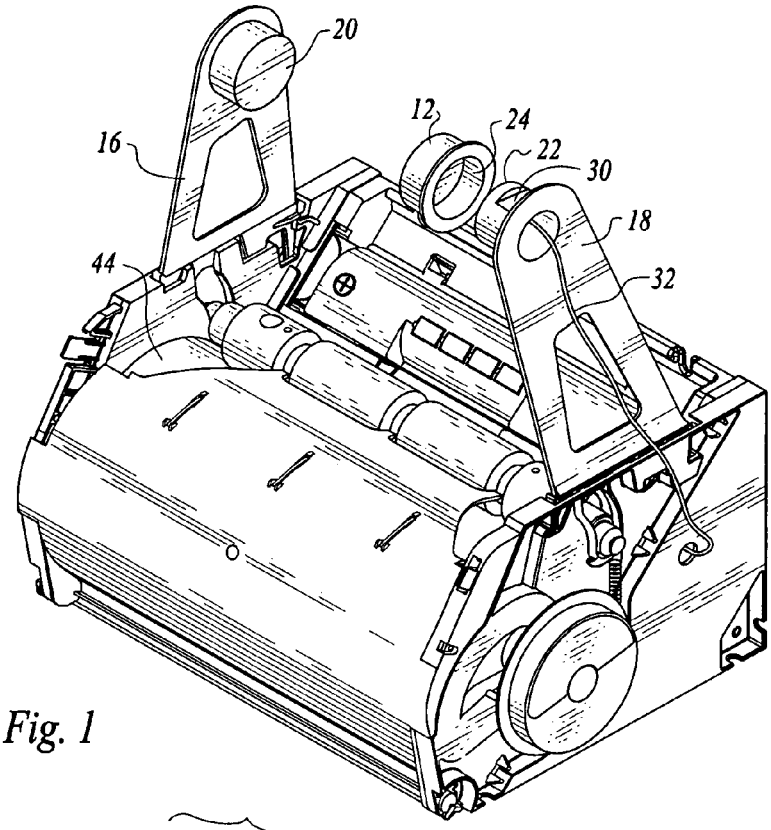
FIG. 1 is a perspective view illustrating a paper towel dispenser incorporating the features of the present invention, the housing normally employed to cover the illustrated structural components not being shown.
Figure 2:
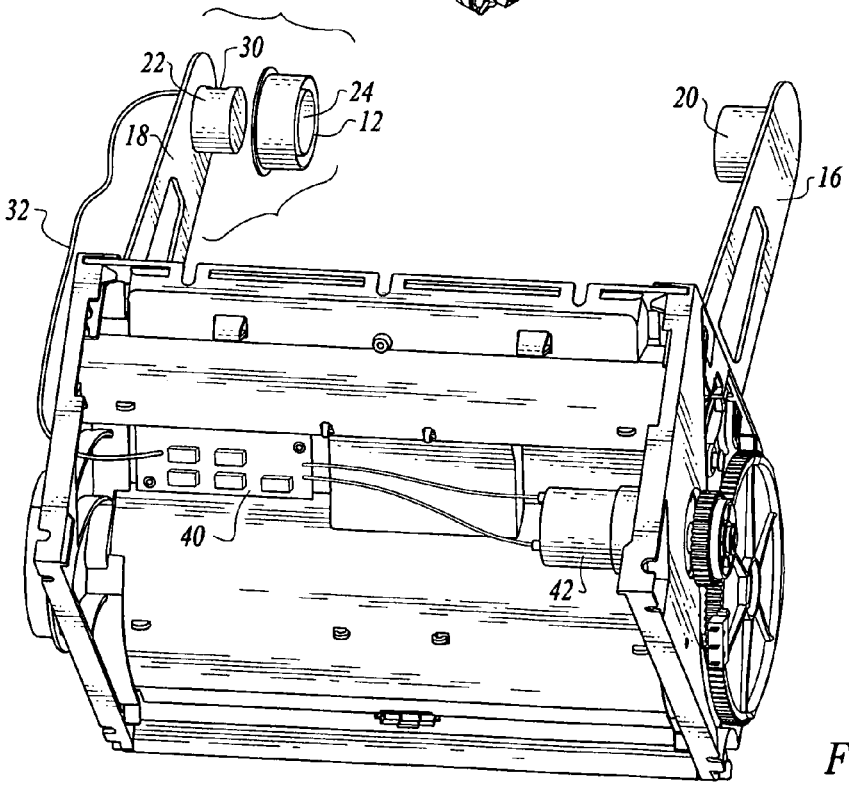
FIG. 2 is a perspective view of the arrangement shown in FIG. 2 as viewed from a direction generally opposed to that of FIG. 1.
Figure 3:
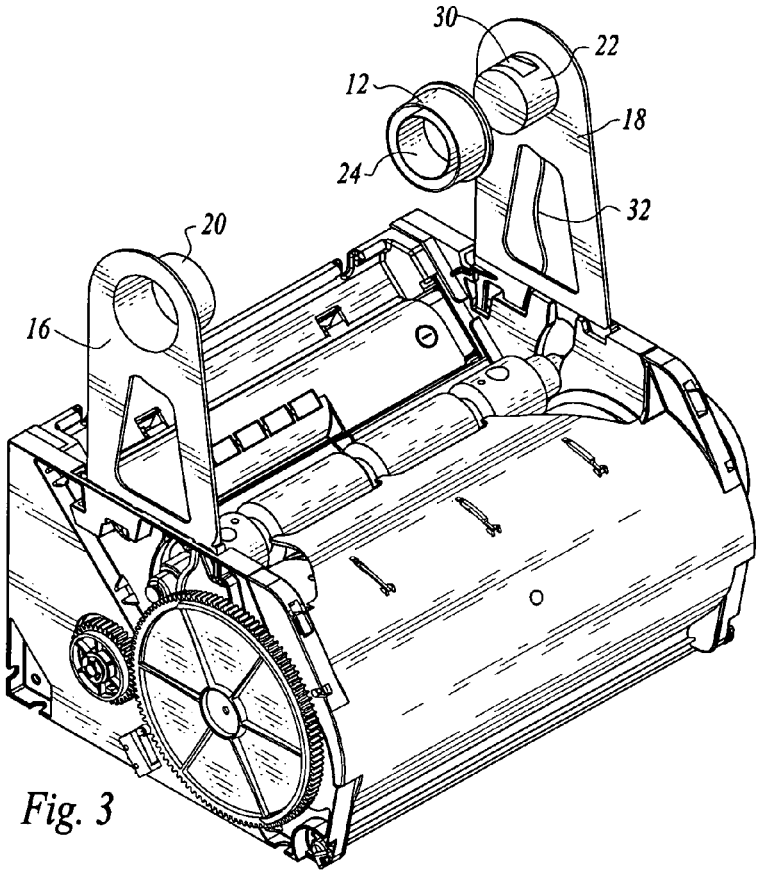
FIG. 3 is a perspective view similar to that of FIG. 1, but illustrating the components as seen from a different viewing angle.
Figure 4:
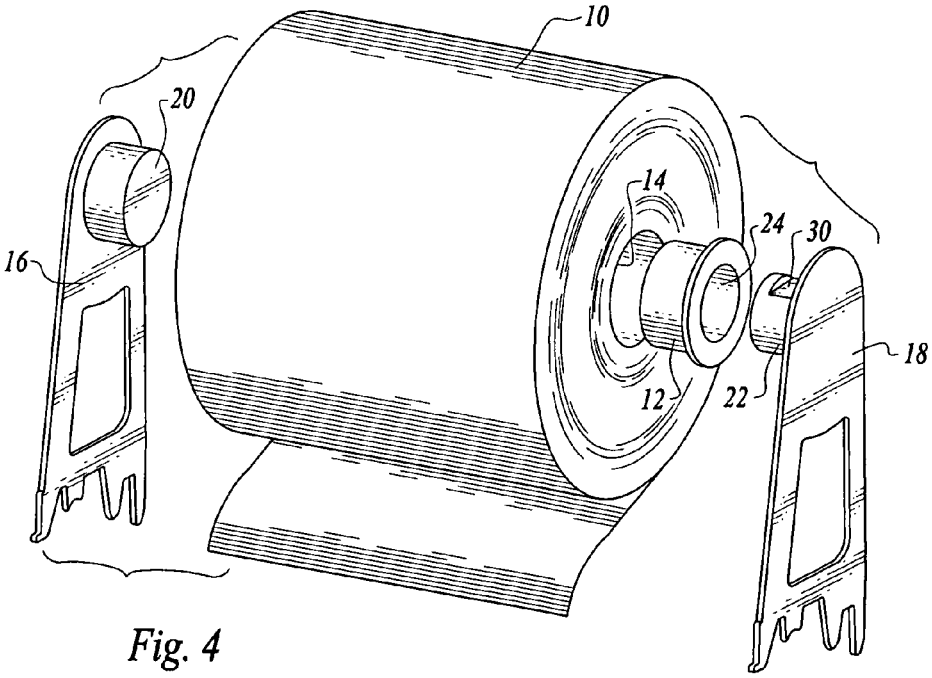
FIG. 4 is an exploded, perspective view illustrating support arms of the dispenser apparatus, a roll of paper toweling to be supported by the support arms and a roll support plug to be positioned in an open end of the roll and defining a recess for receiving a projection on one of the roll support arms.

Referring now to the drawings, FIG. 4 illustrates a roll of paper toweling 10 just prior to insertion of a roll support plug 12 into an end opening 14 of the roll. Also shown in FIG. 4 as well as in the other drawing figures are roll support arms 16, 18 spaced from one another. The roll support arms 16, 18 have inwardly facing projections at opposed ends of the roll to support the roll. The projection of roll support arm 16 is identified by reference numeral 20 and the projection of roll support arm 18 is identified by reference numeral 22.

Projection 22 of roll support arm 18 fits into a recess 24 defined by plug 12. That is, in the arrangement illustrated, the roll support plug 20 is located in illustrated roll end opening 14 and the projection 22 of arm 18 is disposed in the recess 24, allowing for the joint rotation of the roll of paper toweling and the plug relative to projection 22. The projection 20 at the other end of the roll fits directly into the central opening (not shown) at the other end of the roll, no roll support plug being provided in the arrangement shown. However, a roll support plug may be employed at both roll ends if desired.

Roll support plug 12 is wholly or partially comprised of electrically conductive material. For example, the plug 12 may be formed at least partially of electrically conductive plastic or have a metal filler or metal insert in the plastic.

An electrically conductive member in the form of electrically conductive plate 30 is fixedly attached to the projection 20 of support arm 18. Wiring 32 extends from electrically conductive plate 30 to a control device 40 of the dispenser apparatus. The control device may be, for example, a suitably programmed CPU or a hard wired circuit of any suitable type.

The control device 40 is electrically connected to dispenser drive mechanism of the dispenser apparatus and more particularly to an electric motor 42 which is utilized to drive a toweling support drum 44 utilized to effect dispensing of the toweling and causing rotation of the roll of paper toweling 10 relative to the support arms. As mentioned above, this also causes rotation of the plug 12 relative to projection 18 and also relative to the electrically conductive plate 30.

The roll support plug 12 and the electrically conductive plate 30 of the projection of support arm 18 work together to form an "electronic" signature such that the dispenser can recognize the roll support plug 12, the electronic signature sensed using the capacitance distance between the roll support plug and the electrically conductive plate 30 of the support arm 18. That is, the objective is to sense varying degrees of capacitance within the support plug during rotation of the roll 10, meaning different signature levels will be detected differently.

Another way of expressing this is that the capacitance sensing means on the projection 22 is utilized to sense the capacitance characteristics of the plug 12. The plug may be considered a first roll support structure of the invention and the projection 22 may be considered a second roll support structure located at one end of the paper toweling roll. The electrically conductive plate 30 is operable as capacitance sensing means on the second roll support structure for sensing the capacitance characteristics of the first roll support structure and is operatively associated with the dispenser drive mechanism to allow operation of the drive mechanism to dispense sheet material from the roll of sheet material only when the sensed capacitance characteristics of the first roll support structure are of a selected predetermined nature.

Likewise, the electrically conductive plate 30 may be considered to be cooperable with the plug to form an electronic signature based on the capacitance between the plug and the electrically conductive member, the electrically conductive member being operatively associated with the dispenser drive mechanism to allow operation of the dispenser drive mechanism to dispense sheet material from the roll of sheet material only when the electronic signature is of a selected predetermined nature.

The roll support plug 12 may be one of a plurality of plugs having differing capacitance characteristics, the plugs being alternatively insertable into an opening at the end of the roll of sheet material whereby different electronic signatures are produced between the electrically conductive member and different plugs of the plurality of plugs. An alternative way of expressing this is that the control device allows operation of the motor 42 only when the sensed capacitance characteristics of the plug are of a selected predetermined nature. These may be utilized to provide a lock-out feature ensuring that only selected paper toweling or other sheet material is utilizable in a particular dispenser.

Rather than employing a separate plug inserted at a roll end, it is possible that a plug could be part of or associated with a core about which the paper is wound.

The invention claimed is:

1. Paper sheet material dispenser apparatus for dispensing paper sheet material from a roll of paper sheet material, said roll of paper sheet material having opposed first and second roll ends, each roll end defining an opening, said paper sheet material dispenser apparatus comprising, in combination:

first roll support structure connected to a roll of paper sheet material at the first end of the roll of paper sheet material, said first roll support structure comprising a plug positioned in the opening defined by the first end, extending from the opening defined by the first end only part way along the length of said roll of paper sheet material, and said plug in frictional engagement with said roll of paper sheet material and non-rotatable relative to said roll of paper sheet material, said plug defining a recess;

second roll support structure positioned in said recess in engagement with said plug to rotatably support the plug and the first end of the roll of paper sheet material;

dispenser drive mechanism for dispensing paper sheet material from the roll of paper sheet material and causing rotation of the roll of paper sheet material and said plug relative to said second roll support structure when said plug is rotatably supported by said second roll support structure to dispense paper sheet material from the roll of paper sheet material, said plug being wholly or partially formed of electrically conductive material; and capacitance sensing means on said second roll support structure for sensing the capacitance characteristics of said plug operatively associated with said dispenser drive mechanism to allow operation of said dispenser drive mechanism to dispense paper sheet material from the roll of paper sheet material only when the sensed capacitance characteristics of said plug are of a selected predetermined nature, said dispenser drive mechanism including an electric motor and the paper sheet material dispenser apparatus additionally comprising a control device operatively associated with said electric motor and said electrically conductive member, said control device allowing operation of said motor only when the sensed capacitance characteristics of said plug are of said selected predetermined nature.

2. The sheet material dispenser apparatus according to claim 1 wherein said second roll support structure comprises a support arm including a projection for rotatably supporting said plug.

3. The paper sheet material dispenser apparatus according to claim 1 wherein said plug is one of a plurality of plugs having differing capacitance characteristics, said plugs being alternatively insertable into an opening at an end of a roll of paper sheet material and rotatable therewith whereby different electronic signatures are produced between said capacitance sensing means and different plugs of said plurality of plugs.

* * * * *